US008453269B2

(12) United States Patent
Hampton, II

(10) Patent No.: US 8,453,269 B2
(45) Date of Patent: Jun. 4, 2013

(54) STRAP ATTACHMENT FOR A SPORTS HELMET

(75) Inventor: Henry Oliver Hampton, II, Lithonia, GA (US)

(73) Assignee: Henry Hampton, II, Lithonia, GA (US)

( * ) Notice: Subject to any disclaimer, the term of this patent is extended or adjusted under 35 U.S.C. 154(b) by 357 days.

(21) Appl. No.: 12/927,677

(22) Filed: Nov. 22, 2010

(65) Prior Publication Data

US 2012/0124721 A1 May 24, 2012

(51) Int. Cl.
*A63B 71/10* (2006.01)
*A42B 7/00* (2006.01)

(52) U.S. Cl.
USPC ..... 2/425; 2/421

(58) Field of Classification Search
USPC ..... 2/410, 411, 421, 425; 24/663; 411/349, 411/549, 553
See application file for complete search history.

(56) References Cited

U.S. PATENT DOCUMENTS 1,206,504 A * 11/1916 Bishop ..... 24/663
2,407,618 A * 9/1946 Segal ..... 411/553
2,407,619 A * 9/1946 Segal ..... 411/553
3,480,966 A * 12/1969 Molitoris et al. ..... 2/421
3,873,997 A * 4/1975 Gooding ..... 2/413
4,293,984 A * 10/1981 Kaufmann, Jr. ..... 411/553
4,398,306 A * 8/1983 Gooding ..... 2/421
5,368,427 A * 11/1994 Pfaffinger ..... 411/553
5,666,700 A * 9/1997 Anscher et al. ..... 24/163 R
5,799,337 A * 9/1998 Brown ..... 2/421
5,946,735 A * 9/1999 Bayes ..... 2/421
2007/0193006 A1* 8/2007 Kitano et al. ..... 24/323
2007/0245468 A1* 10/2007 Butler ..... 2/418
2008/0028500 A1* 2/2008 Bentz ..... 2/421
2008/0083053 A1* 4/2008 Lin ..... 2/422

* cited by examiner

*Primary Examiner* — Shelley Self
*Assistant Examiner* — Amber Anderson

(57) ABSTRACT

A strap attachment for a helmet with a chin strap, a male quarter turn fastening member, a female quarter turn fastening member, a female fastening member cover plate and a polyfoam padding block. The chin strap has a plurality of apertures. The male fastening member has a dome shaped top portion and a centrally located post attached to its underside. The dome shape is trimmed inwardly creating a secure finger gripping location. The post terminates in an arrow shape. The female fastening member is attached to the inside wall of the sports helmet. The helmet wall has an aperture aligning with the male and female fastening member location. The cover plate placed over the female fastening member. The padding block covers the female fastening member cover. The male fastening member inserted into the female member and turned ninety degrees to lock the two fasteners together.

5 Claims, 10 Drawing Sheets

STRAP ATTACHMENT FOR A SPORTS HELMET

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of strap attachment devices and more specifically to a strap attachment for a sports helmet.

Sports helmets such as football helmets are well known and are used to protect a player's head during contact sport activity.

The football helmet has evolved over the years to make playing the sport of football safer for all players. This includes improvements in internal padding, external shell shape and structure as well as face guards and chin straps.

However, there is a deficiency in the prior technology in that standard football helmets are held onto the user's head by means of chin straps that terminate in female snap members that engage male snap members fixedly attached to the outside wall of the helmet. When a football player is engaged in the extreme contact activity of tackling another player, there is the possibility that the male and female snap portions of the strap will become disengaged causing the helmet to fly off of the user's head and leaving the player's head exposed to possible collision with a hard object, such as another players helmet, or with the ground. Additionally, the attachment of the male to female snap fasteners can be difficult because the user does not have the ability to visually see the location of the snap portions during the attachment process. Finally, the common occurrence of wearing gloves when playing the game of football further hinders the user's tactile sense and makes it increasingly difficult for the user to align the female snap fastener portion to the male snap fastener portion.

BRIEF SUMMARY OF THE INVENTION

The primary object of the invention is to provide a strap attachment for a sports helmet that prevents the strap from disengaging during sports play.

Another object of the invention is to provide a strap attachment for a sports helmet that has a low profile exterior cap that can not injure another player.

Another object of the invention is to provide a strap attachment for a sports helmet that can be used easily even when the user is wearing gloves.

A further object of the invention is to provide a strap attachment for a sports helmet that can be attached and detached without visual assistance.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a strap attachment for a sports helmet comprising: a standard sports helmet, a chin strap, a male quarter turn fastening member, a female quarter turn fastening member, a female fastening member cover plate, a polyfoam padding block, said chin strap having a plurality of evenly space apertures, said male quarter turn fastening member molded from rigid plastic and having a dome shaped top portion and a centrally located post fixedly and perpendicularly attached to the underside of said dome shaped top, said dome shaped top trimmed inwardly on opposing sides creating a secure finger gripping surface. said centrally located post terminating at its distal end in an arrow shape, said arrow shape having flat parallel walls, said flat parallel walls of said arrow shape in the same plane as said dome shape trimmed finger gripping position, said female fastening member fixedly attached to the inside wall of said sports helmet, said helmet wall having an aperture aligning with the said male and female fastening member location, said female fastening member cover plate placed over said female fastening member, and said polyfoam padding block covering said female fastening member cover.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
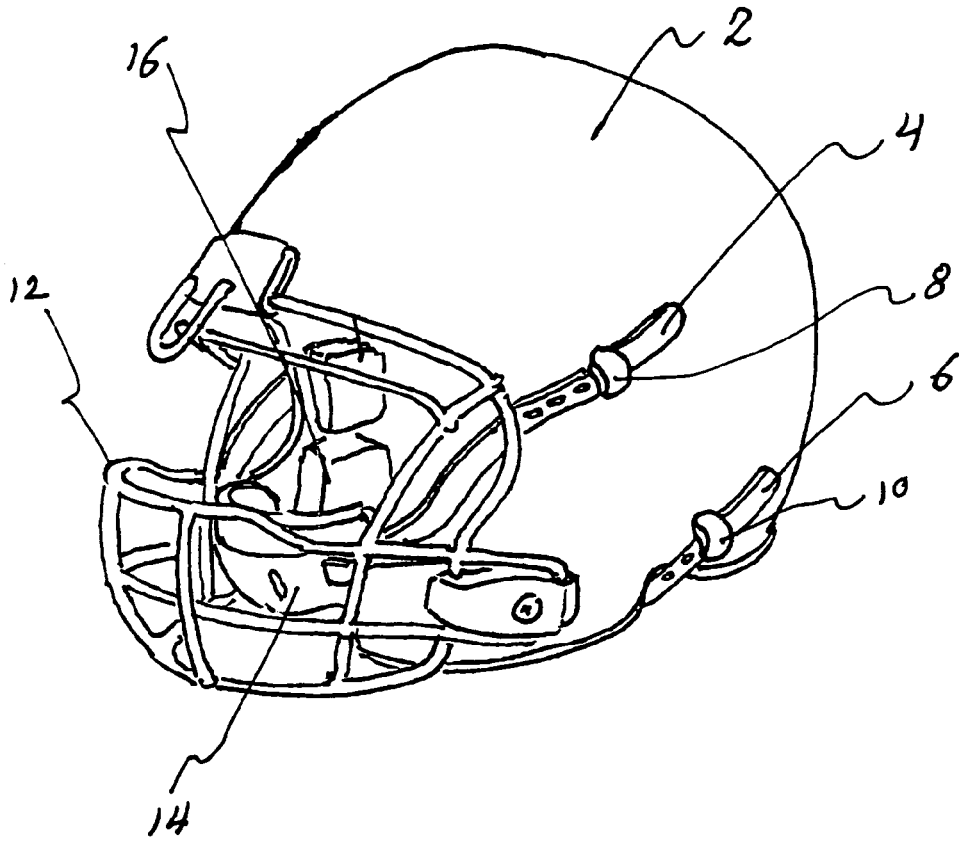
FIG. 1 is a perspective view of the invention.
Figure 4:
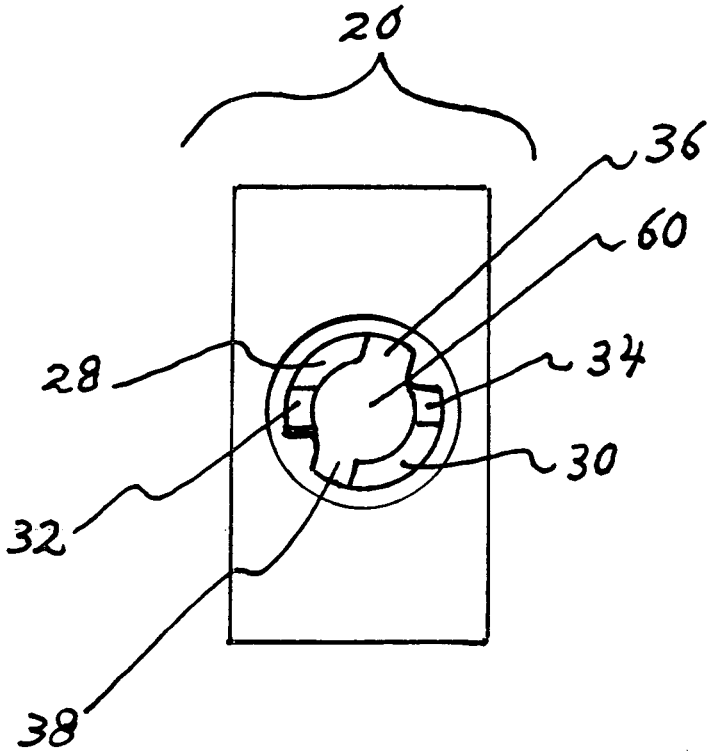
FIG. 4 is a plan view of the female fastening member.
Figure 5:
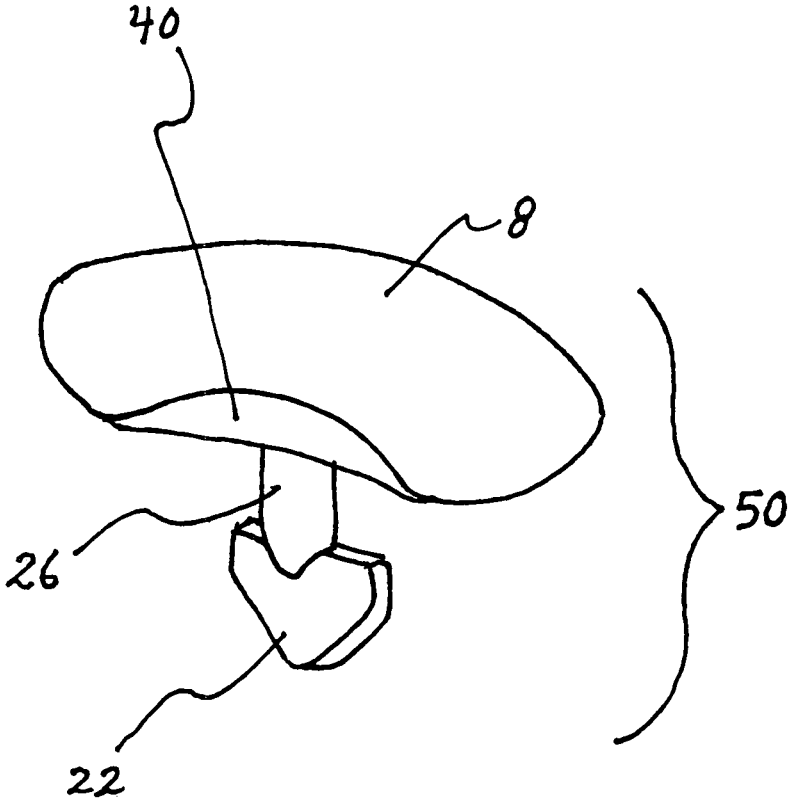
FIG. 5 is a perspective view of the male fastening member.

Referring now to FIG. 1 we see a perspective view of a football helmet 2 having standard features such as a front grill 12 and a chin cup member 14. Chin straps 4, 6 help hold the chin cup 14 in place during play. A matching pair of chin straps 4, 6 can be found on the opposite side of the helmet 2. In current football helmets, male and female snap fasteners are used to hold each strap in place. However, during collisions with other players or with the ground, the snap fasteners may become detached causing the helmet to be dislodged from the user and leaving the user's head exposed to possible injury. The present invention uses a male quarter turn fastening member 50 as shown in FIG. 5 and a female quarter turn fastening member 20 as shown in FIG. 4. The male portion 50 of the fastener is molded of rigid plastic such as nylon. The head 8, 10 of the male fastening member 50 is dome shaped. The male quarter turn fastening member includes a fastener head (8, 10) and locking member, wherein the locking member comprises a male post (26) and an arrow tip (22). There are no sharp corners to the cap portion 8, 10 that could injure another player during use. Standard snap fasteners have metal buckle members that attach the female snap fastener to the male fastener. The buckles have relatively sharp edges which can potentially cause a cut or abrasion on another player while engaged in close and forceful physical contact. The quarter turn fastener system of the present invention locks the strap 4, 6 in place onto helmet 2, so that the helmet 2 can not accidentally come lose during play. Yet, in between play periods, the male post 26 can be easily removed from the female aperture 60, shown in FIG. 4, by rotating the top cap 8, 10 ninety degrees and pulling the post portion 26 out from helmet aperture 52 thereby allowing the user to quickly loosen or remove his helmet 2. It should be noted that the present invention can be applied to other sports helmets such as hockey helmets and lacrosse helmets. Basically, any helmet that requires a strap to hold it in place.

Figure 2:
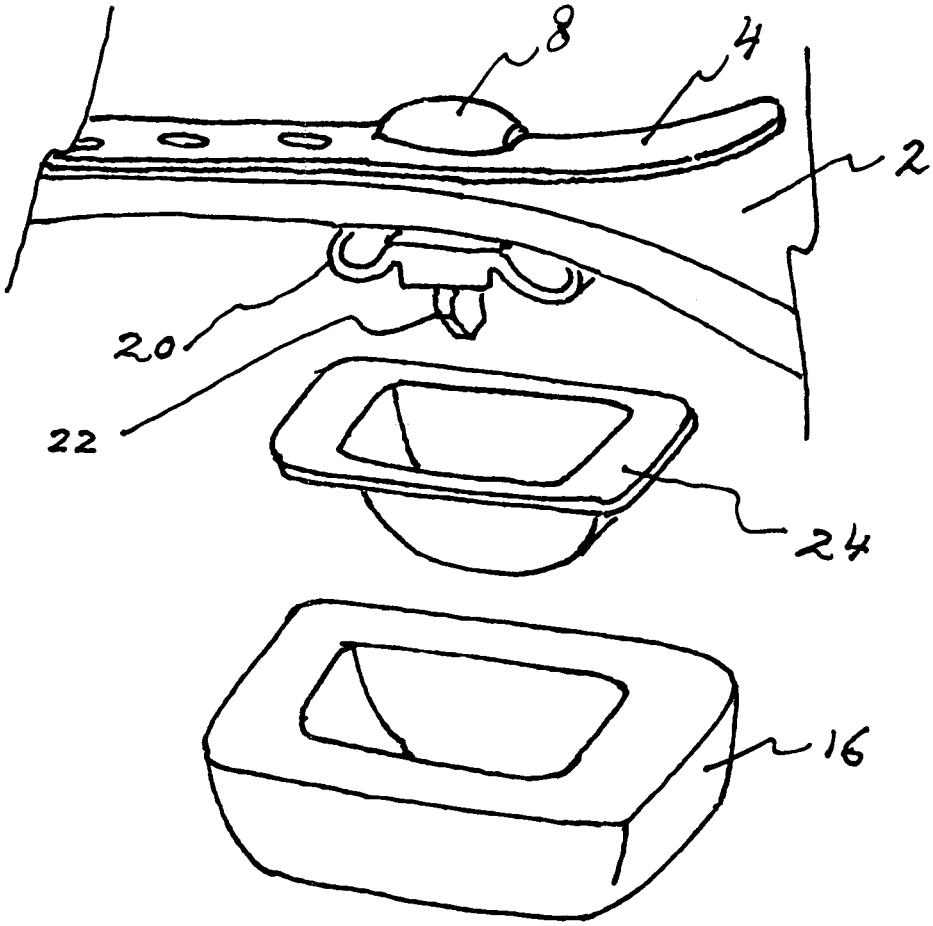
FIG. 2 is an exploded view of the invention.

FIG. 2 shows an exploded view of the invention. The male 50 and female 20 members are locked together capturing strap 4 onto helmet 2. The arrow portion 22 is locked into a retaining aperture 60 shown in FIG. 4. The aperture 60 includes two opposing cutout portions 36, 38 that can accept arrow portion 22. When the user rotates the male fastener 50, the arrow portion rides up ramps 28, 30 until it rests in depressions 32, 34. The spring nature of the resilient arms of the nylon plastic molded female fastener 20 causes the arrow portion 22 of the male fastener 50 to snap into place in depressions 32, 34. Referring back to FIGS. 2 and 3, a cover plate 24 encloses the locking assembly and resilient polyfoam cushion 16 encloses the cover plate 24 thereby protecting the wearer of helmet 2 from potential injury from the arrow point 22.

Figure 3:
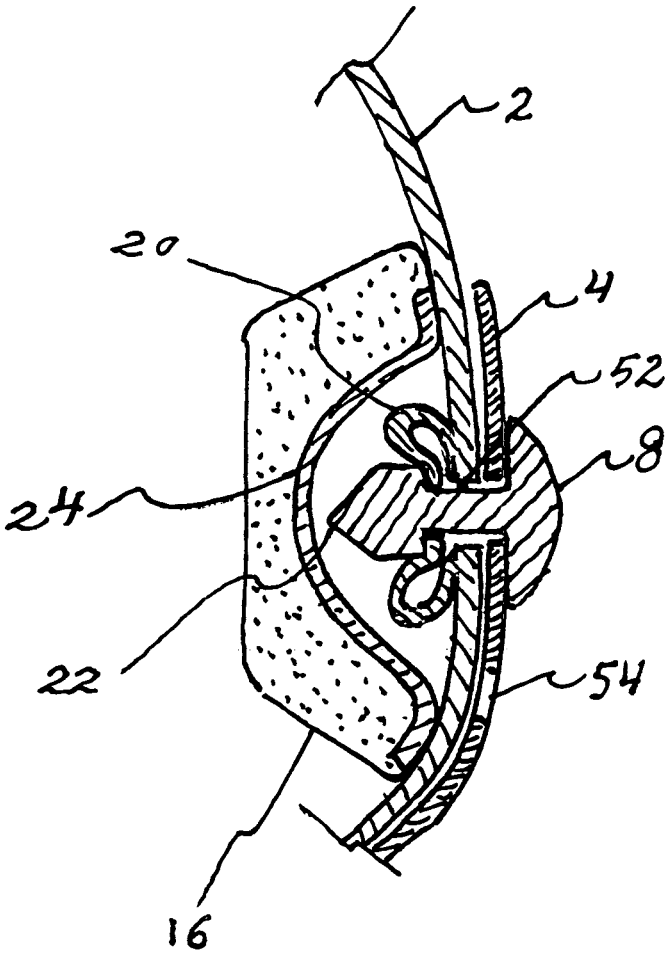
FIG. 3 is a side section view of the invention.
Figure 6:
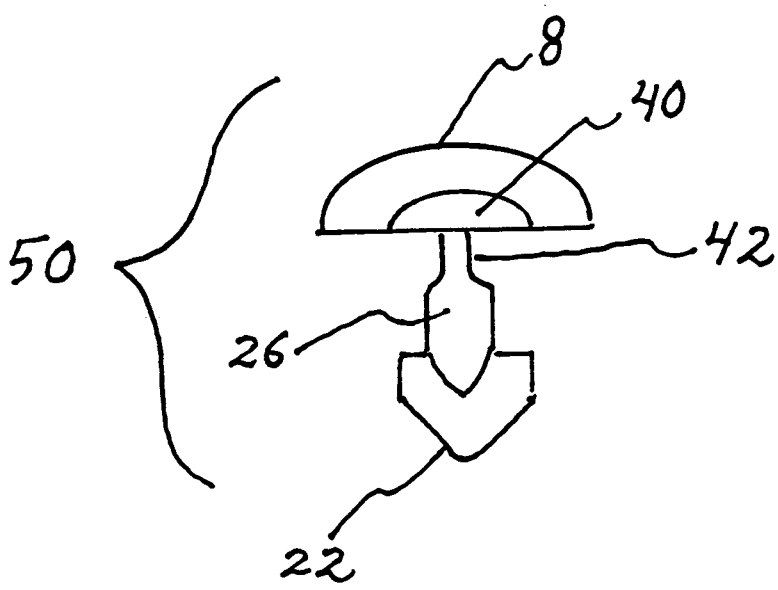
FIG. 6 is a front view of the male fastening member.
Figure 9:
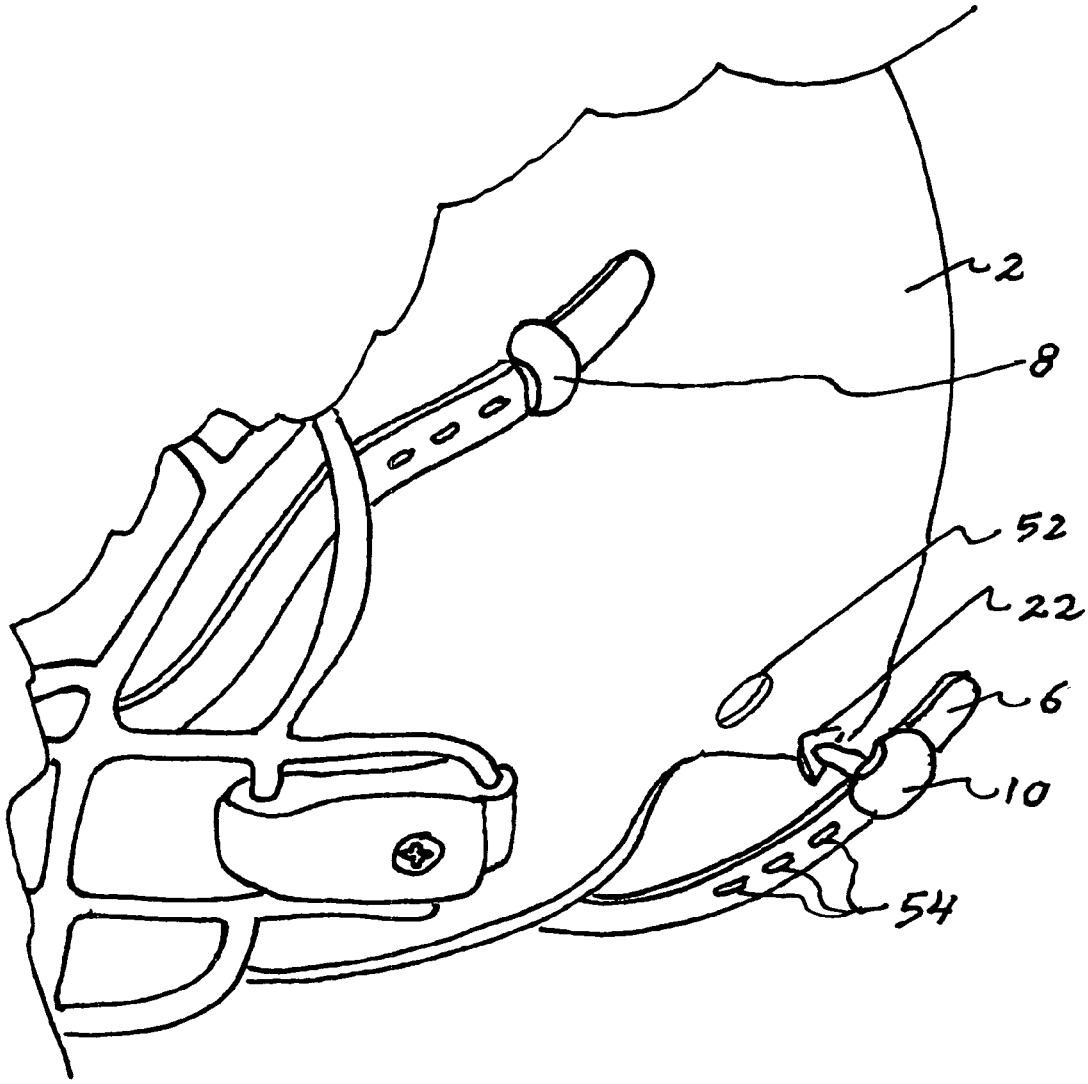
FIG. 9 is a partial perspective view showing a strap about to be attached to a helmet.
Figure 10:
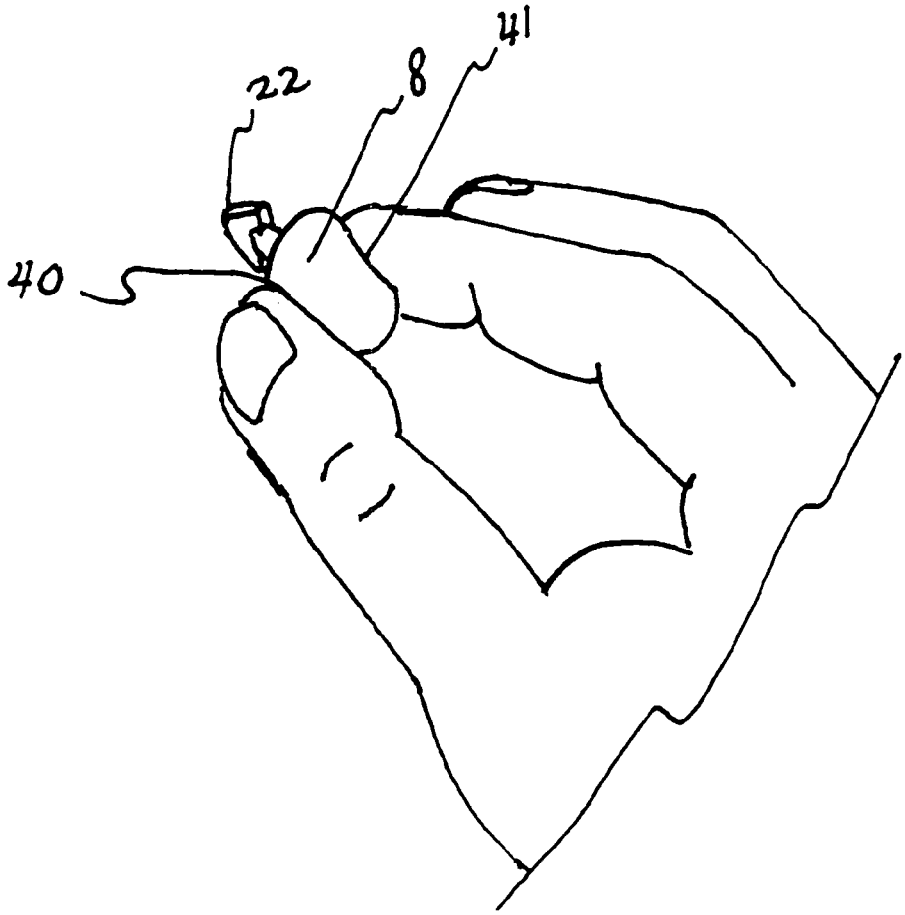
FIG. 10 is a perspective view of a person's fingers engaging the cut out portions of the dome shaped cap of the male fastening member.

FIG. 3 shows a side section view that bisects the male and female locking members. The strap 4 includes a plurality of evenly spaced oblong apertures 54 that allow penetration of arrow portion 22 located at the end of male post 26. the post 26 can then penetrate an aperture 52 in helmet 2 as shown in FIG. 9. The aperture 52 is larger than arrow tip 22 and the pointed shape of the arrow tip 22 allows the user to easily find and engage the oblong aperture 52 without visual assistance. The cut out portions 40, 41 of the dome shaped portion of the male post 26 allow the user to firmly grip the dome shape 8 as shown in FIG. 10 allowing for easy turning of the dome shape 8 as the user is locking the male fastener 50 to the female fastener 20, even if the user is wearing gloves. Additionally, the cut out portions 40, 41 of the male fastener 50 help the user orient the angle of the arrow portion 22 of the post 26 so that the arrow portion automatically is in alignment with the oblong aperture 52 in helmet 2. The oblong shape of the apertures 54 in the strap 6 engage a thinned out portion 42, creating an oblong cross section, of the male post 26 as shown in FIG. 6, so that the orientation of the post 26 remains correctly aligned with the oblong helmet aperture 52 while the user is inserting the post 26 into the aperture 52. Obviously, the same attachment means that takes place with straps 4 and 6 also takes place on the opposite side of the helmet 2 making four attachment points in all.

Figure 7:
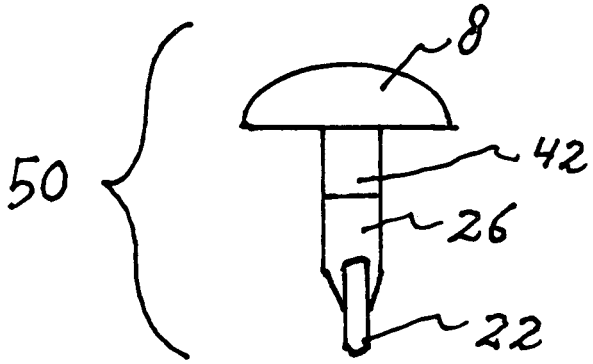
FIG. 7 is a side view of the male fastening member.
Figure 8:
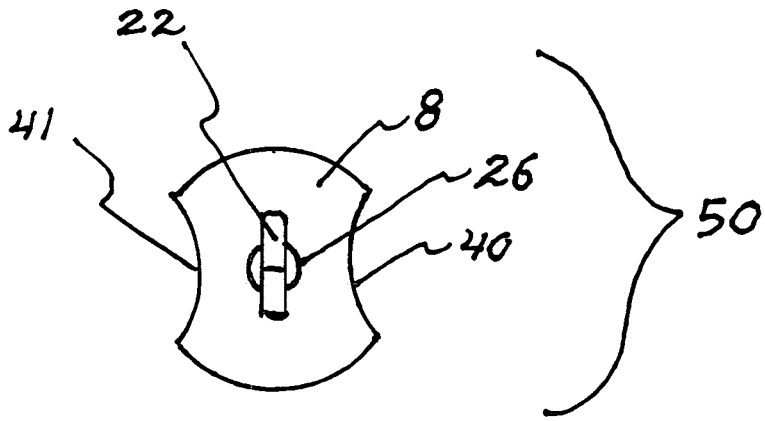
FIG. 8 is a top view of the male fastening member.

FIG. 5 is a perspective view of the male fastening member 50 of the invention. FIG. 6 is a side view of the male fastening member 50, clearly showing the thinner oblong cross section portion 42 that matches the oblong aperture 54 in strap 6. FIG. 7 is a front view of the male fastening member 50. FIG. 8 is a top view of the male fastening member 50 clearly showing finger gripping cut outs 40, 41.

The above described and illustrated invention is a novel way to keep a sports helmet from accidentally becoming dislodged from a person's head during sports play.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A strap attachment for a sports helmet comprising:

a chin strap having a plurality of evenly spaced apertures;

a male quarter turn fastening member having a fastener head fixedly connected to a locking member, wherein the locking member comprises a male post with an arrow-shaped portion at a distal end of the male post, wherein the arrow-shaped portion lies along an insertion plane, and wherein the fastener head has cut out regions aligning with the insertion plane;

wherein the fastener head cut out regions are on opposing sides of the fastener head creating a secure finger gripping;

a female fastening member fixedly attached to an inside wall of the sports helmet, the inside wall having an aperture configured to align with retaining aperture of said female fastening member and any of the plurality of evenly spaced apertures on the chin strap to form an opening, wherein the opening is adapted to receive the arrow-shaped portion of the locking member;

a cover plate enclosing said female fastening member; and a cushioning member enclosing said cover plate.

2. A strap attachment for a sports helmet as claimed in claim 1 wherein:

said chin strap apertures are oblong shaped; and said central post having a matching oblong cross section making it easier to align an orientation of said male quarter turn fastening member with a proper orientation of said female quarter turn fastening member.

3. A strap attachment for a sports helmet as claimed in claim 1, wherein the male quarter turn fastening member is molded from rigid plastic.

4. A strap attachment for a sports helmet as claimed in claim 1, wherein the female fastening member has a pair of ramps on an exposed surface adapted to guide the arrow-shaped locking member into a locking position.

5. A strap attachment for a sports helmet as claimed in claim 1, wherein the cushioning member is a polyfoam block.

* * * * *